United States Patent [19]

Krautkremer

[11] 4,175,511

[45] Nov. 27, 1979

[54] TUGBOAT OR THE LIKE

[75] Inventor: Franz Krautkremer, Spay, Fed. Rep. of Germany

[73] Assignee: Schottel-Werft Josef Becker GmbH & Co. KG, Rheinland, Fed. Rep. of Germany

[21] Appl. No.: 852,031

[22] Filed: Nov. 16, 1977

[30] Foreign Application Priority Data

Dec. 8, 1976 [DE] Fed. Rep. of Germany ..... 2655667

[51] Int. Cl.[2] ..... B63H 5/12

[52] U.S. Cl. ..... 115/35; 114/151; 115/41 R; 248/640

[58] Field of Search ..... 114/151; 115/34 R, 35, 115/37, 41 R, 41 HT; 192/18 A; 248/4, 5, 6

[56] References Cited

U.S. PATENT DOCUMENTS

| | | | |
|---|---|---|---|
| 2,302,795 | 11/1942 | Noble | 115/41 R |
| 2,885,990 | 5/1959 | Hawthorne | 115/35 |
| 3,770,085 | 11/1973 | Cottingham | 192/18 A |
| 3,807,347 | 4/1974 | Baldwin | 115/41 R |

*Primary Examiner*—Jesus D. Sotelo

*Attorney, Agent, or Firm*—Blanchard, Flynn, Thiel, Boutell & Tanis

[57] ABSTRACT

A steerable propeller arrangement in a watercraft wherein the propeller is mounted in the forward one-half of the hull of the watercraft. The steerable propeller projects downwardly from the bottom portion of the hull and is pivotal about 360°. The propeller is mounted in a downwardly opening cylindrical well in the bottom of the hull and is housed in an inner cylindrical member which is spaced radially inwardly from an outer cylindrical wall defining the well in the hull. The steerable propeller arrangement can be removed from the hull by raising the inner cylindrical member and propeller upwardly into the interior of the watercraft. Thrust blocks are provided between the two cylindrical members to absorb thrust applied by the drivable propeller arrangement.

7 Claims, 6 Drawing Figures

TUGBOAT OR THE LIKE

FIELD OF THE INVENTION

The invention relates to a drivable watercraft and, more particularly, relates to a steerable propeller arrangement wherein the steerable propeller is mounted in the forward one-half of the hull of the watercraft and projects downwardly therefrom.

BACKGROUND OF THE INVENTION

The basic purpose of the invention is to produce a vehicle of the above-mentioned type, in which the driving mechanism, in particular the steerable propeller or propellers, are arranged such that they can be lifted out upwardly, namely when the vehicle is floating. A good transfer of the thrust from the driving mechanism (propeller) onto the hull of the vehicle must thereby be assured.

SUMMARY OF THE INVENTION

A drivable watercraft having at least one driving mechanism, particularly a steerable propeller which acts onto the water and is arranged on the bottom side of the front half of the hull of the watercraft. The steerable propeller is arranged in a downwardly opening well and consists of two substantially concentric well walls, of which the outer well wall is a substantially fixed part of the hull of the watercraft and the inner well wall is removably mounted on the outer well wall, the removal being in the upward direction. The steerable propeller is secured to the inner well wall and the inner well wall is smaller in circumference than the smallest diameter of the outer well wall.

Thrust blocks are used to assure a good transfer of the thrust from the driving mechanism onto the hull of the watercraft. The thrust blocks are thereby understood to be a ring combination or a number of blocks distributed over the periphery.

BRIEF DESCRIPTION OF THE DRAWINGS

Further characteristics and advantages of the invention can be taken from the following description with reference being made to the accompanying drawings, in which.

DETAILED DESCRIPTION

Figure 1:
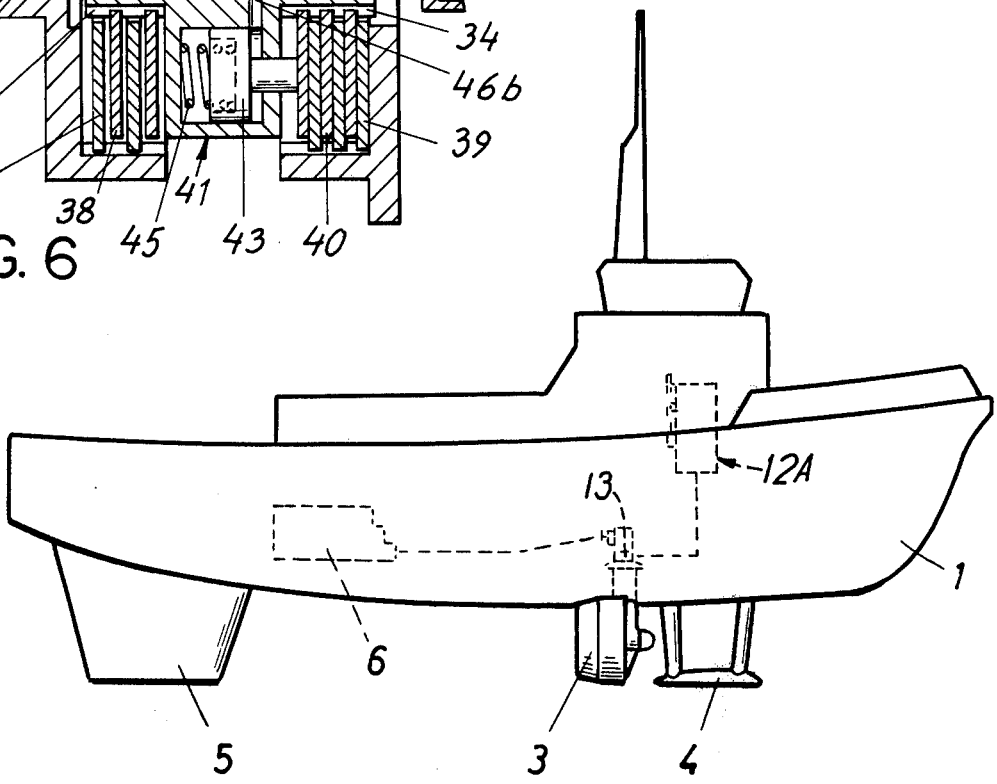
FIG. 1 schematically illustrates a watercraft embodying the invention.
Figure 2:
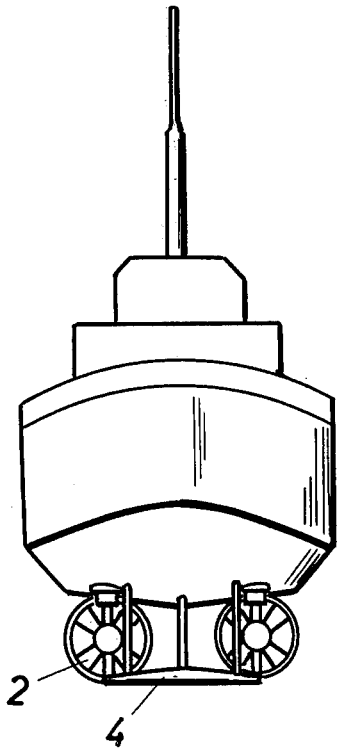
FIG. 2 schematically illustrates the front view of FIG. 1.
Figure 3:
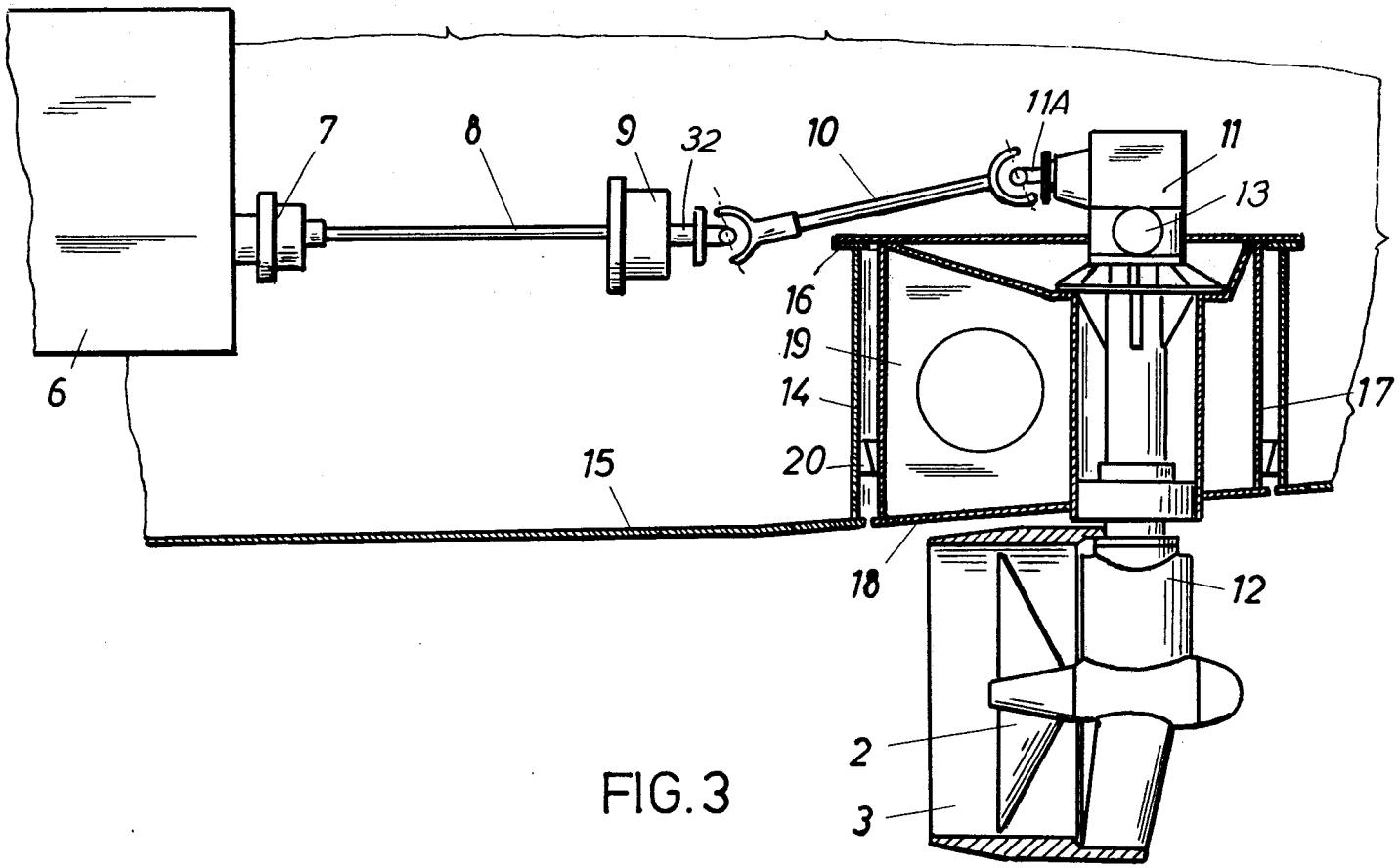
FIG. 3 illustrates one exemplary embodiment of the invention.

FIG. 1 illustrates a tugboat 1 which is driven by two side-by-side steerable propellers 2 both of which are pivotal 360° about substantially vertical axes for the purpose of controlling the vehicle. The steerable propellers 2 are arranged in front of the center of the boat approximately at the one-third location ($\frac{1}{3}$) of the entire boat length, measured from the bow, namely so that the flow of water to the propeller and the discharge below the hull can take place freely. The propellers rotate in so-called Kort nozzles 3. A protective device 4 is provided in front of the propellers and a stabilizing fin 5 is provided at the rear. The fin 5 acts as a balancing surface for traversing maneuvers. The protective device and the stabilizing surface serve also as a protective support for the boat when it is removed from the water so that the propellers will not be damaged.

The steerable propellers 2 are driven by one or two motors 6 arranged in the boat behind the steerable propellers, thus in the rear half of the watercraft. The transfer of drive torque from the motor to the steerable propeller or propellers (hereinafter reference will be in singular terms) is accomplised first through a flexible compensating coupling 7, a shaft 8, and thence to a shifting coupling 9 (i.e. like Great Britain Pat. No. 1,138,319, U.S. Pat. No. 2,124,097 or the like). The shifting coupling 9 is combined with a not illustrated disk brake (FIG. 6 or like U.S. Pat. No. 2,658,593 or the like) which engages automatically when the coupling separates the motor from the propeller. The brake is used to absorb the flywheel moment of the propeller so that the propeller can be stopped quickly, which in particular during use in a harbor is a good maneuvering aid, where often changes of speed and stop maneuvering are necessary.

Figure 6:
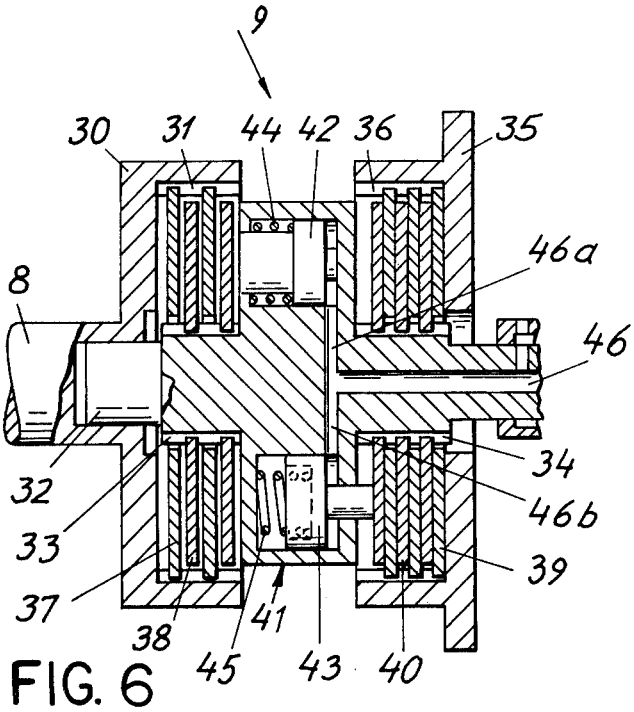
FIG. 6 illustrates schematically a coupling and a brake in combination.

FIG. 6 illustrates schematically an example of a combination of a shifting coupling and a brake, as it is mentioned above, however, with the difference that for the brake, lamellae are provided instead of disks. The housing which encloses all of it is not shown. At the driven end of the shaft 8 there is provided an outer coupling housing 30 having internal teeth 31. An intermediate shaft 32 is supported in the shaft 8 or in the coupling housing, which intermediate shaft has two outer sets of external teeth 33, 34. One of these sets of teeth is in the radial range of the coupling housing 30. In the radial range of the second set of external teeth 34, there is provided a stationary housing 35 having internal teeth 36. At the end of the intermediate shaft 32, the propeller shaft 10 is pivotally connected through a cardan joint or the like. Inner and outer lamellae 37, 38; 39, 40 engage alternately the internal and external teeth. A cylinder housing 41 is arranged on the intermediate shaft between the two sets of external teeth 33, 34. The cylinder housing 41 has a ring of coupling pistons 42 and a ring of brake pistons 43 being closely guided therein. The coupling pistons 42 are axially held by springs 44 always in the sense of disengagement. The brake cylinders are always held axially in the sense of the braking engagement by springs 45. If the said pistons 42, 43 are loaded with pressure medium through channels 46, 46*a*, 46*b*, then the lamellae 39, 40 are released and the brake is disengaged. The lamellae 37, 38 are simultaneously compressed and the coupling is engaged. When the pressure is removed, uncoupling takes place automatically with the springs 44, 45 and simultaneously braking is accomplished through the springs 44, 45. By inserting known and not shown check valves and/or throttles, the coupling and braking operations can be adjusted timewise to one another.

The shifting coupling 9 is connected to the steerable propeller through a drive shaft 10. The entire steerable propeller consists substantially of one stationary above-water housing 11 and a below-water housing 12, which is pivotally supported on the above-water housing through 360°. The torque is transmitted in a conventional manner from the driven input shaft 11A through a beveled gear (not shown) in the above-water housing, a substantially vertical shaft (also not shown) which extends into the below-water housing 12, a beveled gear (also not shown) which is arranged in the below-water housing and thence onto a substantially horizontal propeller shaft rotatably supporting the propeller. The pivotal movement of the below-water housing 12 is controlled from the steering control stand through a schematically illustrated mechanical transfer mechanism or an electric, hydraulic or pneumatic remote control indicated by the reference 12A in FIG. 1. The receiver of this remote control is schematically indicated and is identified with reference numeral 13. The receiver acts through a not shown gearing in a conventional manner onto the said below-water housing to effect the pivoting through 360°.

To support the steerable propeller, a watertight compartment or well construction is provided in the bottom of the boat. The well consists substantially of a cylindrical outer wall 14 extending into the hull and forming one unit with the hull 15 by being, for example, welded to the hull. The outer well wall is provided with a flange 16 at the upper end. An inner hollow housing having a cylindrical well wall 17 is arranged substantially centrically to the outer well wall and is spaced radially inwardly therefrom. The inner well wall 17 also has a flange at the upper end, which flange fits on the aforementioned flange 16 and both are fastened together. A floor 18 is provided at the lower end of the inner well and closes off the well flush with the hull of the ship. The upper edge of the well lies above the waterline when the ship is empty. The above-water housing 11 of the steerable propeller is fitted and secured in the cylinder which is formed by the inner well wall. A plurality of radially extending ribs 19 in the inner well 17 assures rigidity in the construction thereto.

Figure 4:
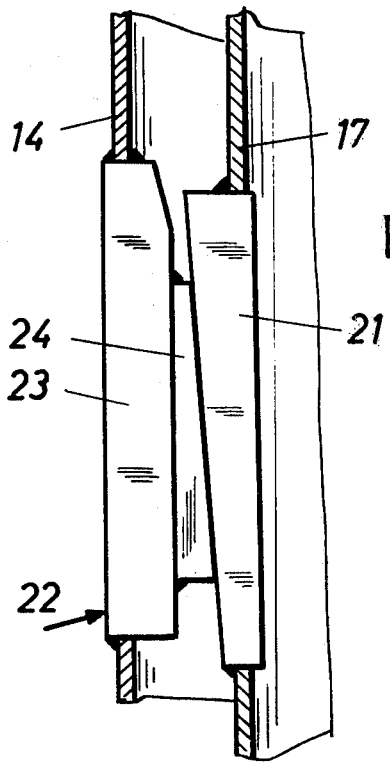
FIG. 4 illustrates a detail of one exemplary embodiment of the invention.
Figure 5:
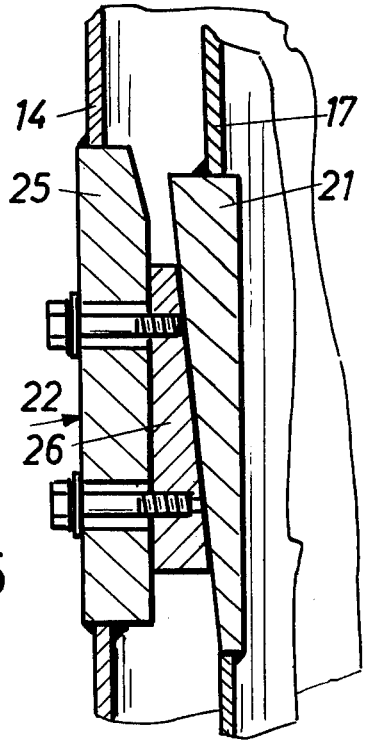
FIG. 5 illustrates a detail of a different exemplary embodiment of the invention.

The radial space between the outer and the inner well walls is bridged by at least one annular thrust block or several block-like thrust blocks 20, which are illustrated more in detail in FIGS. 4 and 5. A platelike support member 21 is secured to the inner well wall, for example, by means of welding and has an inclined surface thereon inclined toward the outer well wall. The direction of the inclination will be described below. A counter support member 22 is recessed and secured, for example by welding, from the outside through an opening or the like in the outer well wall. The counter support member consists of two parts, namely of an outer part 23 made of a material which can easily be welded and an inner wedge 24, the material of which functionally fits with the support member, in particular is corrosion resistant. The inclined surfaces of the support member 21 and of the wedge 24 are directed such that the inner well wall can be lifted out upwardly with the steerable propeller attached thereto. The dimensions of the outer well wall are also chosen for this purpose. The support member and counter support member are adjusted during installation and only thereafter is the outer part 23 welded in place.

In the embodiment according to FIG. 5, the outer part 25 of the counter support member is also welded to the outer well wall, however, the wedge 26 is adjustably connected with the outer part, for example is fastened such that it can also be adjusted later on. FIG. 5 shows for this a simple form, examples of which are known, for example setscrews or the like, which are complicated, however, possibly allow for easier adjustments. Generally once adjustment has been made, it is never adjusted later on.

The arrangement of the driving mechanism, thus in the disclosed example steerable propellers in the front part of the boat, permits a mounting of the tow hook at the rear end of the boat to achieve a maximum distance between the two hook and propellers. This assures a high degree of stability and operating reliability under all possible operating conditions.

Although particular preferred embodiments of the invention have been disclosed in detail for illustrative purposes, it will be recognized that variations or modifications of the disclosed apparatus, including the rearrangement of parts, lie within the the scope of the present invention.

The embodiments of the invention in which an exclusive property or privilege is claimed are defined as follows:

1. A drivable propeller arrangement for a watercraft, comprising:

a watertight compartment formed in the lower hull of said watercraft and having a downwardly open port therefrom to below said watercraft, the upper end of said watertight compartment being positioned above the waterline on said watercraft;

a hollow housing removably mounted in said compartment, the maximum peripheral dimension of said housing in a horizontal plane being less than the minimum peripheral dimension of said compartment in a horizontal plane thereby defining a spacing therebetween, said housing having a lower wall flush with the surface of said lower hull;

steerable propeller means mounted on said housing, said steerable propeller means extending through the hollow part of said housing and through said lower wall and having a propeller means supported for rotation about a horizontal axis on a lower end thereof below said lower wall, the maximum peripheral dimension of said propeller means in a horizontal plane being less than said peripheral dimension of said compartment; and support means for said housing including a laterally extending flange on said housing which rests on the upper end of said watertight compartment and plural thrust blocks received in said spacing to thereby stabilize said housing with said compartment.

2. The drivable propeller according to claim 1 wherein said thrust blocks each consist substantially of two support members with cooperating inclined surfaces which fit on one another, an inner one of said support members being secured to the inner wall of said compartment and the outer one of said support members being secured to the outer wall of said housing and the inclination of said surfaces are directed such that said housing can be removed only upwardly with said steerable propeller means.

3. The drivable propeller according to claim 2, wherein said support members include means for facilitating an adjustment thereof with respect to one another to control the stabilization of said housing to said compartment.

4. The drivable propeller according to claim 1, including a motor on said watercraft and a torque-transmitting means between said motor to said steerable propeller means, said torque-transmitting means including a shiftable coupling having a combined clutch coupling and a friction brake and control means for effecting an engagement of said friction brake when said clutch coupling is disengaged.

5. The drivable propeller according to claim 1, wherein said hollow housing is cylindrically-shaped and said compartment is cylindrically-shaped so that said spacing therebetween is uniform.

6. The drivable propeller according to claim 1, wherein said watertight compartment is located in the forward half of said lower hull of said watercraft.

7. A drivable propeller arrangement for a watercraft, comprising:

a watertight compartment of cylindrical cross section formed in the forward lower hull of said watercraft and having a downwardly opening port therefrom to below said watercraft, the upper end of said watertight compartment being positioned above the waterline on said watercraft;

a hollow cylindrical housing removably mounted in said compartment, said housing being concentric with said compartment with the peripheral dimension of said housing in a horizontal plane being less than the peripheral dimension of said compartment also in a horizontal plane thereby defining a spacing therebetween, said housing having a lower wall flush with the surface of said lower hull;

steerable propeller means mounted on said housing, said steerable propeller means extending through the hollow part of said housing and through said lower wall and having a propeller means supported for rotation about a horizontal axis on a lower end thereof below said lower wall, said propeller means being also supported for rotation about a vertical axis, the maximum peripheral dimension of the portion of said propeller means spaced radially from said vertical axis being less than the peripheral dimension of said compartment in all positions of said propeller means relative to said hull; and circumferential support means in said spacing for facilitating an upward movement of said housing with said steerable propeller means secured thereto relative to said compartment to enable a removal of said housing and said steerable propeller means from said compartment no matter what the position of said propeller means is relative to said hull, said circumferential support means further effecting a stabilizing of said housing to said compartment by preventing relative movement therebetween during operation of said propeller means positioned below said lower hull, said support means including a laterally extending flange on said housing which rests on the upper end of said watertight compartment and plural thrust blocks received in said spacing to thereby stabilize said housing with said compartment.

* * * * *